US009270049B2

(12) United States Patent
Jinno et al.

(10) Patent No.: US 9,270,049 B2
(45) Date of Patent: Feb. 23, 2016

(54) WATERPROOF CONNECTOR

(71) Applicant: YAZAKI CORPORATION, Tokyo (JP)

(72) Inventors: Keishi Jinno, Makinohara (JP); Kouichi Ohyama, Makinohara (JP); Kazunori Miura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/176,296

(22) Filed: Feb. 10, 2014

(65) Prior Publication Data

US 2014/0154916 A1 Jun. 5, 2014

Related U.S. Application Data

(63) Continuation of application No. PCT/JP2012/070865, filed on Aug. 10, 2012.

(30) Foreign Application Priority Data

Aug. 11, 2011 (JP) ..... 2011-175612

(51) Int. Cl.
*H01R 13/52* (2006.01)
*H01R 12/77* (2011.01)
(Continued)

(52) U.S. Cl.
CPC ..... *H01R 13/5205* (2013.01); *H01R 12/771* (2013.01); *H01R 13/405* (2013.01); *H01R 13/50* (2013.01); *H01R 13/521* (2013.01); *H01R 43/24* (2013.01); *H01R 13/5845* (2013.01)

(58) Field of Classification Search
CPC ..... H01R 13/5205; H01R 13/5219; H01R 2201/26; H01R 13/5216
See application file for complete search history.

(56) References Cited

U.S. PATENT DOCUMENTS 3,568,131 A * 3/1971 Kennedy ..... 439/155
5,928,033 A * 7/1999 Kato ..... H01R 13/5216 174/77 R (Continued)

FOREIGN PATENT DOCUMENTS

CN 1934754 A 3/2007
DE 10227602 A1 1/2004

(Continued)

OTHER PUBLICATIONS

Office Action dated Dec. 30, 2014 issued by Korean Patent Intellectual Property Office in counterpart Korean Patent Application No. 10-2014-7002663.

(Continued)

*Primary Examiner* — Truc Nguyen
(74) *Attorney, Agent, or Firm* — Sughrue Mion, PLLC

(57) ABSTRACT

A waterproof connector includes a flat cable having an insulating sheath part in which a conductive wire is coated with an insulating film, a terminal connected to the conductive wire, and a connector housing fitted to a mating connector so as to connect the terminal to a mating terminal of the mating connector. The connector housing includes a mold part which is integrally formed with an end part in an extending direction of the flat cable and which covers a connecting part of the conductive wire and the terminal. The insulating sheath part has a pair of cut-out parts. The pair of cut-put parts are formed at positions which are covered with the connector housing and located at side end parts of the insulating sheath part opposed to each other in a transverse direction of the insulating sheath part.

5 Claims, 12 Drawing Sheets

(51) Int. Cl.

| | |
|---|---|
| ***H01R 13/405*** | (2006.01) |
| ***H01R 13/50*** | (2006.01) |
| ***H01R 43/24*** | (2006.01) |
| *H01R 13/58* | (2006.01) |

(56) References Cited

U.S. PATENT DOCUMENTS

| | | | | |
|---|---|---|---|---|
| 7,309,256 | B2 * | 12/2007 | Alloway | B60R 16/0207 439/606 |
| 7,494,375 | B2 * | 2/2009 | Yoshikai | 439/595 |
| 8,690,614 | B2 * | 4/2014 | Eshima | H01R 4/185 439/882 |
| 8,840,412 | B2 * | 9/2014 | Ohyama | H01R 13/5221 439/271 |
| 2002/0126457 | A1 * | 9/2002 | Kameyama | H01R 13/6658 361/728 |
| 2004/0235364 | A1 * | 11/2004 | Matsumoto | B60L 11/1898 439/752 |
| 2005/0255748 | A1 * | 11/2005 | Kameyama | H01R 13/5208 439/587 |
| 2007/0037436 | A1 * | 2/2007 | Iwahori | H01R 13/5205 439/422 |
| 2009/0280688 | A1 * | 11/2009 | Kawada | H01Q 1/1271 439/620.01 |

FOREIGN PATENT DOCUMENTS

| | | | |
|---|---|---|---|
| JP | 06-310224 | A | 11/1994 |
| JP | 2002-170627 | A | 6/2002 |
| JP | 2003-092160 | A | 3/2003 |
| JP | 2003-92160 | A | 3/2003 |
| JP | 2003-174266 | A | 6/2003 |
| JP | 2008-171597 | A | 7/2008 |
| JP | 2008-192545 | A | 8/2008 |

OTHER PUBLICATIONS

Office Action dated Mar. 24, 2015, issued by the Japanese Patent Office in counterpart Japanese Application No. 2011-175612.

Notice to Submit Response dated Jul. 21, 2015 issued by the Korean Intellectual Property Office in counterpart Korean Patent Application No. 10-2014-7002663.

Office Action dated Jul. 3, 2015 issued by the State Intellectual Property Office of the People's Republic of China in counterpart Chinese Patent Application No. 201280039299.0.

Office Action issued Jun. 30, 2015, issued by the Japanese Patent Office in counterpart Japanese Patent Application No. 2011-175612.

International Search Report for PCT/JP2012/070865 dated Nov. 28, 2012 [PCT/ISA/210].

Written Opinion for PCT/JP2012/070865 dated Nov. 28, 2012 [PCT/ISA/237].

* cited by examiner

WATERPROOF CONNECTOR

CROSS REFERENCE TO RELATED APPLICATIONS

This application is a continuation of PCT application No. PCT/JP2012/070865, which was filed on Aug. 10, 2012 based on Japanese Patent Application (No. 2011-175612) filed on Aug. 11, 2011, the contents of which are incorporated herein by reference.

BACKGROUND OF THE INVENTION

1. Field of the Invention

The present disclosure relates to a waterproof connector for a flat cable.

2. Description of the Related Art

Usually, for a wiring in a narrow space, a flat plate like flat cable having flexibility is used. In this flat cable, a terminal connected to a mating terminal of a mating connector is connected to a part in which a conductive wire of the flat cable is exposed. A connecting part of such a conductive wire and the terminal needs to be waterproofed. Accordingly, a flat cable waterproof connector having a waterproofing performance is proposed (for instance, see JP-A-2008-171597).

The flat cable waterproof connector disclosed in JP-A-2008-171597 has a waterproof plug provided between a connector housing and the flat cable.

SUMMARY OF THE INVENTION

However, in the flat cable waterproof connector disclosed in JP-A-2008-171597, since the waterproof plug needs to be attached to the connector housing, a problem arises that an attaching operation is complicated.

The present disclosure is devised by considering the above-described problem and it is an object of the present disclosure to provide a waterproof connector for flat cable in which a waterproofing performance can be obtained and an attaching operation is easy.

In order to solve the above-described problems and achieve the object, there is provided a waterproof connector according to the present disclosure, including: a flat cable having an insulating sheath part in which a conductive wire is coated with an insulating film, a terminal connected to the conductive wire, and a connector housing fitted to a mating connector so as to connect the terminal to a mating terminal of the mating connector. The connector housing includes a mold part which is integrally formed with an end part in an extending direction of the flat cable and which covers a connecting part of the conductive wire and the terminal.

For example, the mold part includes: a waterproof mold part which covers the connecting part; and a holding mold part arranged between the waterproof mold part and the flat cable to cover the flat cable.

For example, the insulating sheath part has a pair of cut-out parts or through holes, the pair of cut-put parts are formed at positions which are covered with the connector housing and located at side end parts of the insulating sheath part opposed to each other in a transverse direction of the insulating sheath part, and the through holes are formed at positions which are covered with the connector housing.

For example, the connector housing includes a fitting part which is fitted to the mating connector, and the fitting part has a hood part which accommodates at least a part of the mating connector.

For example, the fitting part has a fitting lock part which holds a fitting state to the mating connector.

According to the present disclosure, there is also provided a manufacturing method of a waterproof connector, comprising:

providing a flat cable having an insulating sheath part in which a conductive wire is coated with an insulating film; and forming a connector housing fitted to a mating connector so as to connect a terminal to a mating terminal of the mating connector by integrally forming the connector housing with both of the flat cable and a connecting part of the conductive wire and the terminal in a state that the terminal is connected to the conductive wire.

In the waterproof connector according to the above configuration, since the connector housing is formed integrally with the end part in the extending direction of the flat cable so as to cover the connecting part of the conductive wire and the terminal, a waterproofing performance can be obtained without attaching a waterproof plug between the connector housing and the flat cable. As a result, the waterproofing performance is obtained and an attaching operation is made to be easy.

The waterproof connector according to the above configuration, since the mold part includes the waterproof mold part which covers the connecting part and the holding mold part located more inward in the extending direction of the flat cable than the waterproof mold part to cover the flat cable, a load applied to the waterproof mold part is reduced by the holding mold part. Thus, the waterproof mold part can be prevented from being broken. As a result, the waterproofing performance of the waterproof mold part can be improved.

The waterproof connector according to the above configuration, since a resin forming the connector housing enters the pair of cut-out parts or the through holes, the connector housing is strongly held on the flat cable.

The waterproof connector according to the above configuration, since the connector housing includes the fitting part having the hood part which accommodates at least a part of the mating connector and fitted to the mating connector, the waterproofing performance of a connecting part of the terminals and mating terminals can be ensured.

The waterproof connector according to the above configuration, since the fitting part has the fitting lock part for holding the fitting state to the mating connector, the fitting state of the connector housing to the mating connector can be more strongly held.

Further, since the manufacturing method of the waterproof connector includes the integrally forming step in which the connector housing is formed integrally with the connecting part of the conductive wires and the terminals and the flat cable, the waterproofing performance can be obtained without attaching the waterproof plug between the connector housing and the flat cable. As a result, the waterproofing performance is obtained and the attaching operation is made to be easy.

DETAILED DESCRIPTION OF THE EXEMPLARY EMBODIMENTS

Figure 1:
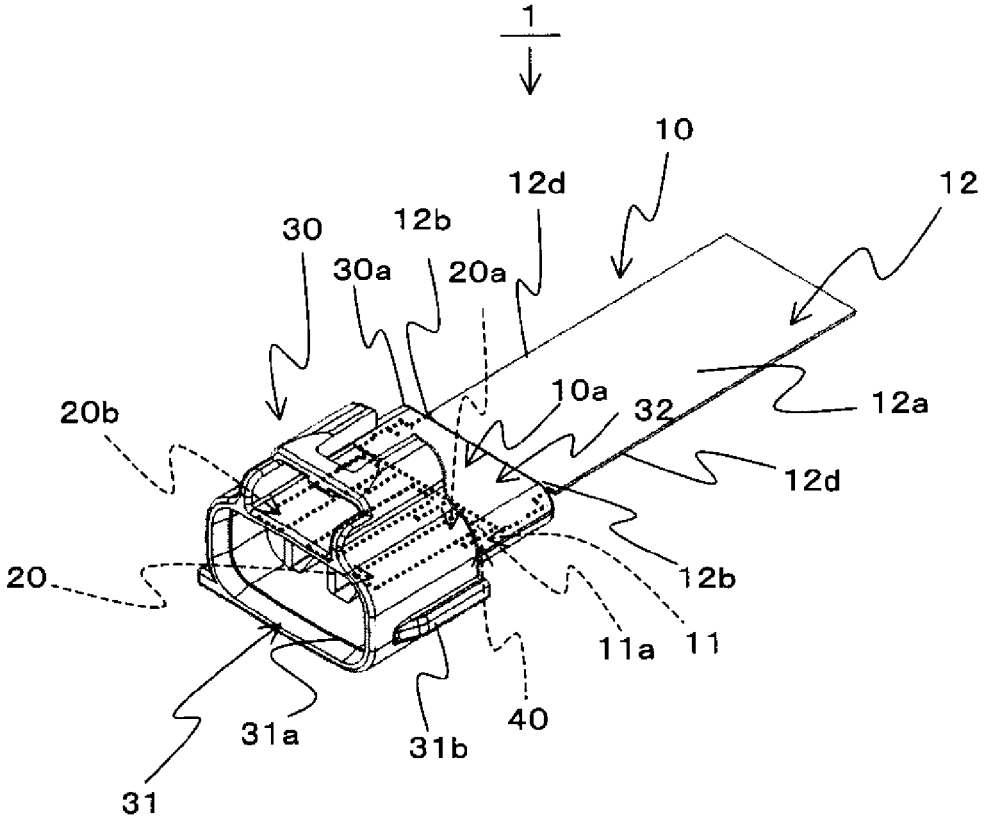
FIG. 1 is a perspective view of a flat cable waterproof connector according to an exemplary embodiment of the present disclosure.

Now, by referring to the drawings, a preferred exemplary embodiment of a flat cable waterproof connector and its manufacturing method according to the present disclosure will be described below in detail.

Exemplary Embodiment

Figure 2:
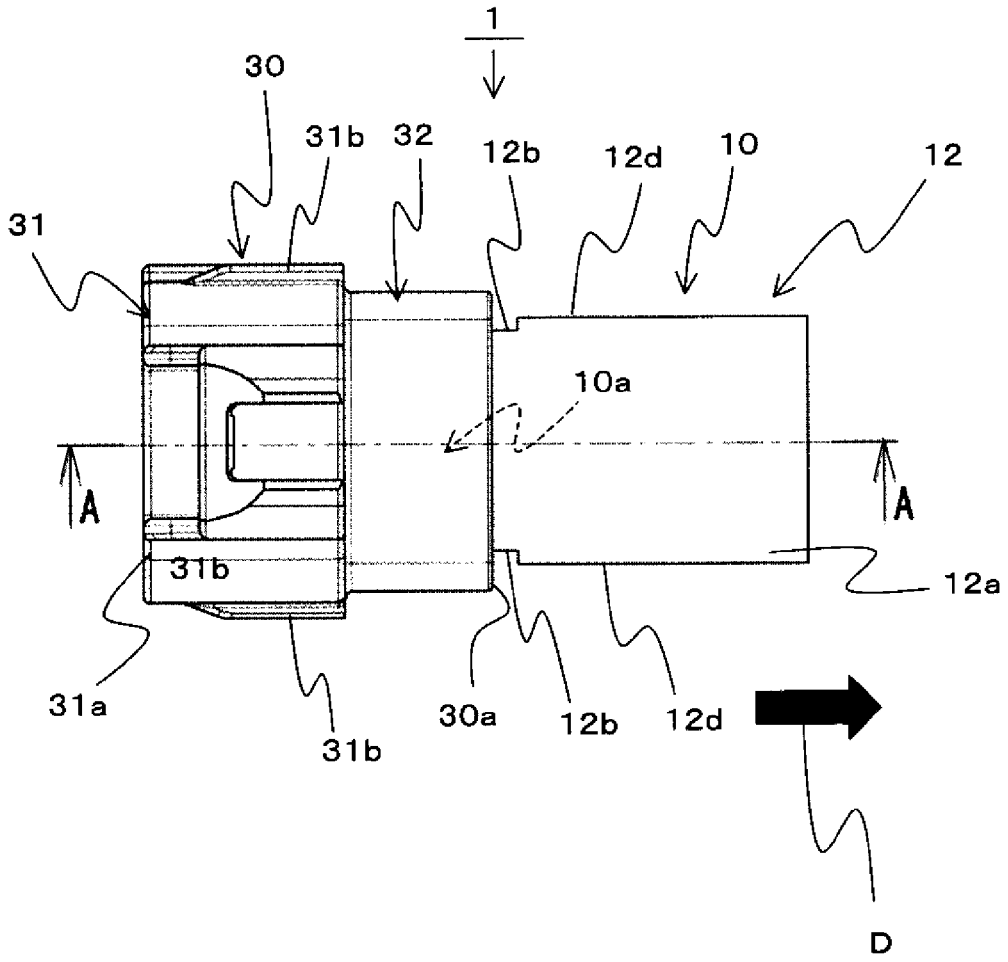
FIG. 2 is a top view of the flat cable waterproof connector shown in FIG. 1.
Figure 3:
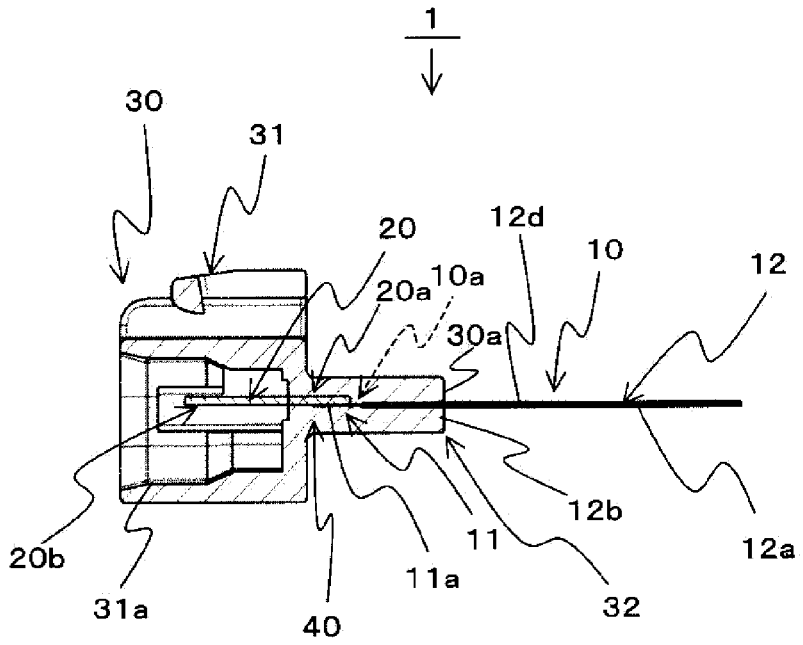
FIG. 3 is a sectional view taken along a line A-A in the flat cable waterproof connector shown in FIG. 2.
Figure 4:
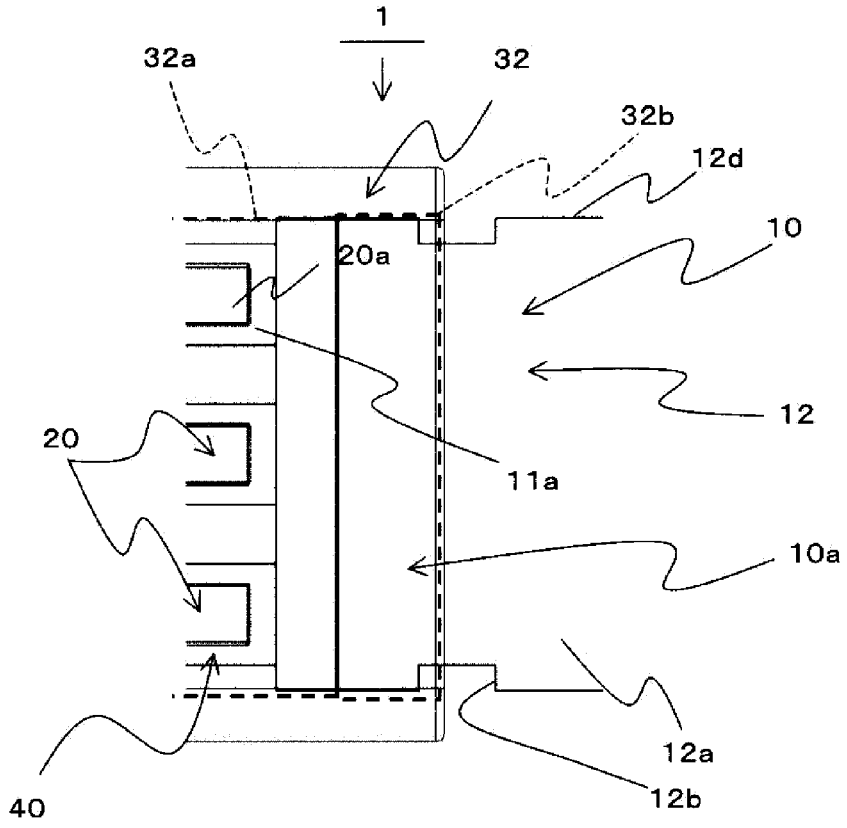
FIG. 4 is an enlarged view of a periphery of a mold part shown in FIG. 1.
Figure 5:
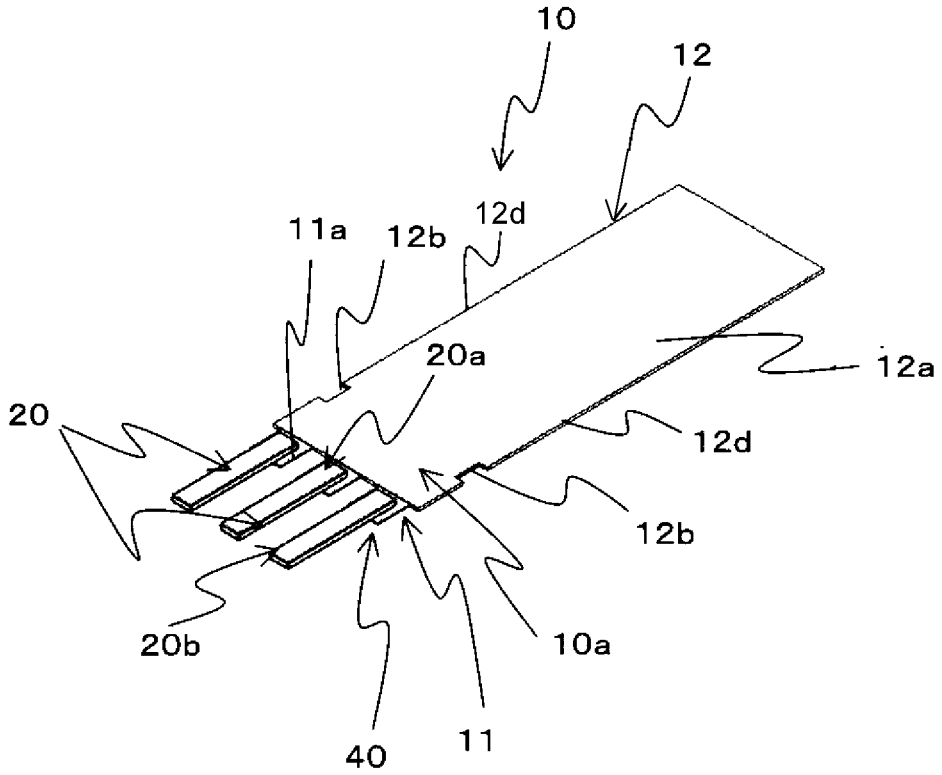
FIG. 5 is a diagram of a flat cable shown in FIG. 1 and terminals connected to the flat cable.
Figure 6:
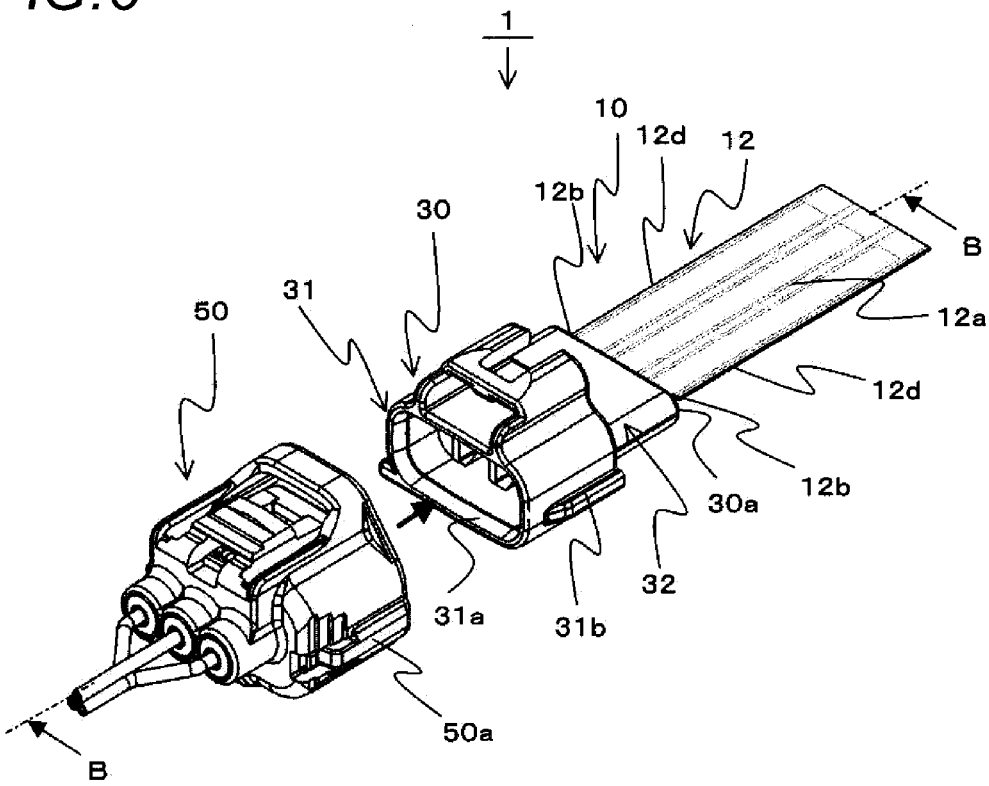
FIG. 6 is a view showing the flat cable waterproof connector shown in FIG. 1 and a mating connector in a state before the mating connector is fitted to a connector housing shown in FIG. 1.
Figure 7:
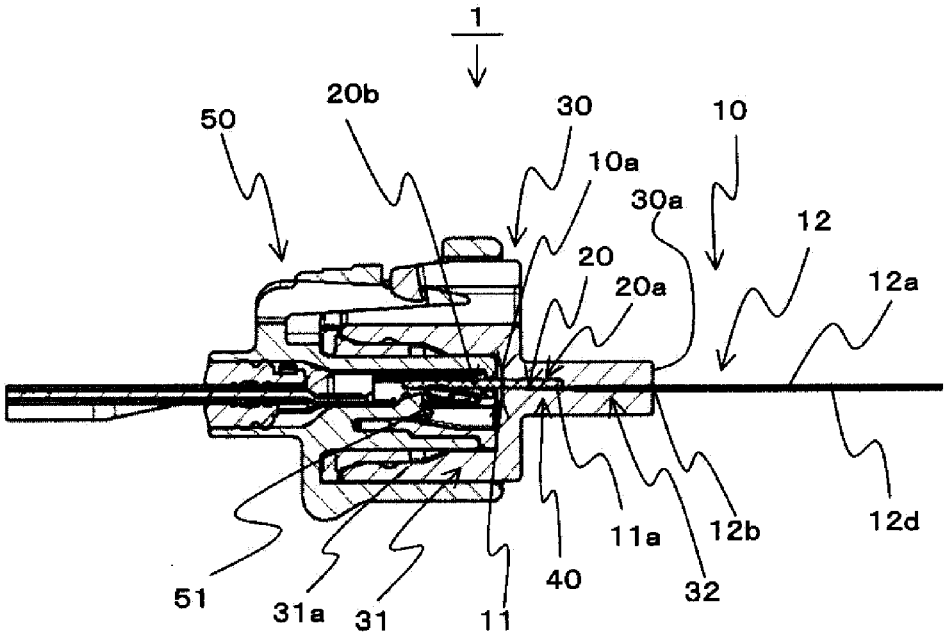
FIG. 7 is a sectional view taken along a line B-B in a state that the connector housing is fitted to the mating connector shown in FIG. 6.

FIG. 1 is a perspective view of a flat cable waterproof connector 1 according to an exemplary embodiment of the present disclosure. FIG. 2 is a top view of the flat cable waterproof connector 1 shown in FIG. 1. FIG. 3 is a sectional view taken along a line A-A in the flat cable waterproof connector 1 shown in FIG. 2. FIG. 4 is an enlarged view of a periphery of a mold part 32 shown in FIG. 1. FIG. 5 is a diagram of a flat cable 10 shown in FIG. 1 and terminals 20 connected to the flat cable 10. FIG. 6 is a view showing the flat cable waterproof connector 1 shown in FIG. 1 and a mating connector 50 in a state before the mating connector 50 is fitted to a connector housing 30 shown in FIG. 1. FIG. 7 is a sectional view taken along a line B-B in a state that the connector housing 30 is fitted to the mating connector 50 shown in FIG. 6.

As shown in FIG. 1 to FIG. 4, the flat cable waterproof connector 1 includes a flat cable 10, three terminals 20 and a connector housing 30.

The flat cable 10 includes, as shown in FIG. 5, a conductor part 11 and an insulating sheath part 12.

The conductor part 11 is formed with copper or copper alloy and has three flexible conductive wires 11*a*. The conductive wires 11*a* of the three conductive wires 11*a* are respectively arranged in parallel at intervals corresponding to intervals at which the terminals 20 are arranged in parallel.

In the present exemplary embodiment, is exemplified the conductor part 11 having the three conductive wires 11*a*, however, the present disclosure is not limited thereto. Namely, the number of the conductive wires 11*a* may be one or more.

The insulating sheath part 12 is a part having the conductor part 11 coated with an insulating film 12*a* such as polypropylene.

The insulating sheath part 12 has a pair of cut-out parts 12*b*. The pair of cut-out parts 12*b* are rectangular cut-out parts formed at positions where at least parts thereof are covered with side end parts 12*d* opposed to each other in a transverse direction of the insulating sheath part 12 and the connector housing 30. In the present exemplary embodiment, the cut-out parts 12*b* of the pair of cut-out parts 12*b* are respectively formed at positions substantially equal to a position of an attaching side end 30*a* of the flat cable 10 of the connector housing 30 in the extending direction of the flat cable 10.

In such a flat cable 10, as shown in FIG. 5, the conductor part 11 is coated with the insulating film 12*a* in a flat plate form so that the flat cable 10 has a flexibility. Further, in the flat cable 10, the insulating film 12*a* of an end part 10*a* of a side connected to the terminals 20 is removed so that the conductive wires 11*a* are respectively exposed. To the exposed conductive wires 11*a*, the terminals 20 are respectively connected.

Now, the three terminals 20 will be described below.

The terminals 20 of the three terminals 20 respectively have forms corresponding to those of the conductive wires 11*a*, and are respectively connected to the conductive wires 11*a* by an ultrasonic welding method or a pressure welding method. In the present exemplary embodiment, the terminals 20 are respectively male terminals and end parts 20*b* opposed to end parts 20*a* in a side connected to the conductive wires 11*a* are connected to below-described mating terminals 51.

In the present exemplary embodiment, the flat cable waterproof connector 1 which has the three terminals 20 is exemplified, however, the present disclosure is not limited thereto. Namely, the terminals 20 having the number corresponding to the number of the conductive wires 11*a* may be simply provided.

Now, the connector housing 30 will be described below.

The connector housing 30 is formed with a synthetic resin and is fitted to the existing mating connector 50 of the connection mate so that the terminals 20 are connected to the mating terminals 51, as shown in FIG. 6 and FIG. 7.

The connector housing 30 is formed integrally with a connecting part 40 of the conductive wires 11*a* and the terminals 20 and the flat cable 10, and includes a fitting part 31 fitted to the mating connector 50 and a mold part 32.

The fitting part 31 has an elliptic tubular outer form in section and the existing mating connector 50 is fitted thereto. Namely, when the mating connector 50 is fitted to the fitting part 31, the terminals 20 are respectively connected to the mating terminals 51. Further, the fitting part 31 has a hood part 31*a* and a fitting lock part 31*b*.

The hood part 31*a* is a part for accommodating at least a part of the mating connector 50.

The fitting lock part 31*b* is a part for holding a fitting state to the mating connector 50. The fitting lock part 31*b* is, for instance, a protruding part extending straight along a fitting direction from an outer surface of the fitting part 31. As shown in FIG. 6, in the mating connector 50, a fitting lock part 50*a* of the mating connector 50 is formed so as to cover the fitting lock part 31*b* is provided correspondingly to the fitting lock part 31*b*. Accordingly, when the connector housing 30 is fitted to the mating connector 50, the fitting lock part 31*b* is fitted to the fitting lock part 50*a* side. Thus, the fitting state can be more strongly held.

The mold part 32 is a part which molds the connecting part 40 and holds the end part 10*a* of the flat cable 10 in the side to which the terminals 20 are connected, namely, the end part 10*a* in the extending direction of the flat cable 10 integrally with the fitting part 31. More specifically, the mold part 32 includes a waterproof mold part 32*a* and a holding mold part 32*b* as shown in FIG. 4.

The waterproof mold part 32*a* is extended to the extending direction of the flat cable 10 from the fitting part 31 to cover the connecting part 40 so as to waterproof it. Accordingly, since the connecting part 40 is allowed to strongly come into close contact by the connector housing 30, a waterproofing property is improved in the connecting part 40.

The holding mold part 32*b* is a part located more inward in the extending direction of the flat cable 10 than the waterproof mold part 32*a* to cover the flat cable 10. More specifically, the holding mold part 32*b* is further extended toward the extending direction of the flat cable 10 from the waterproof mold part 32*a* to cover the end part 10*a* in the direction of the flat cable 10. Therefore, since the end part 10*a* in the extending direction is covered with the connector housing 30 in a wider area, the flat cable 10 is stably held by the holding mold part 32*b*.

Accordingly, a load applied to the waterproof mold part 32*a* is reduced by the holding mold part 32*b*, so that the waterproof mold part 32*a* can be prevented from being broken. As a result, a waterproofing performance of the waterproof mold part 32*a* can be improved.

Since such a connector housing 30 is formed integrally with the connecting part 40 and the flat cable 10 with the synthetic resin forming the connector housing 30, the connector housing 30 is allowed to come into close contact with the connecting part 40 and the flat cable 10 so as to cover the connecting par 40 and the flat cable 10. Accordingly, a waterproof plug does not need to be provided separately from the connector housing 30. The waterproofing performance is obtained by the connector housing 30.

Further, the attaching side end 30*a* of the connector housing 30 is arranged in the extending direction of the flat cable 10 and at the position substantially equal to the positions of the pair of cut-out parts 12*b*. Accordingly, since the resin forming the connector housing 30 enters the pair of cut-out parts 12*b*, the connector housing 30 is strongly held on the flat cable 10. Further, as shown in FIG. 2, since the resin is formed so as to cover one sides of sides forming the cut-out parts 12 in directions intersecting the extending direction of the flat cable 10, the flat cable 10 is held with a high holding force to a tensile force (a direction D shown by an arrow D in FIG. 2) in the extending direction of the flat cable 10.

Figure 8A:
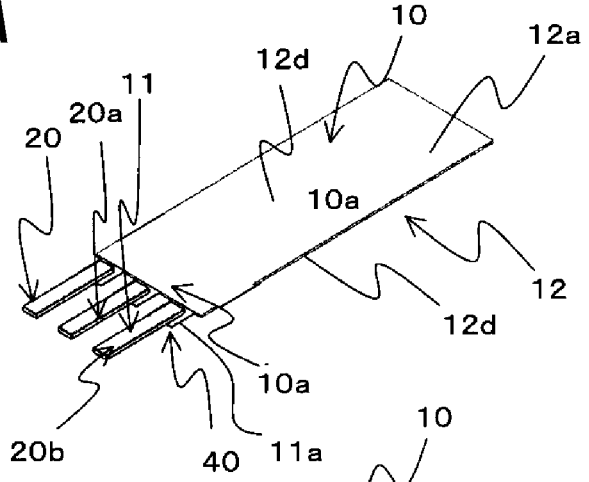
FIGS. 8A to 8C are diagrams showing a manufacturing method of the flat cable waterproof connector shown in FIG. 1.
Figure 8B:
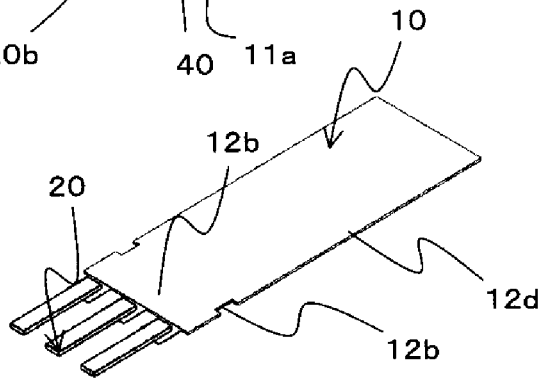
Figure 8C:
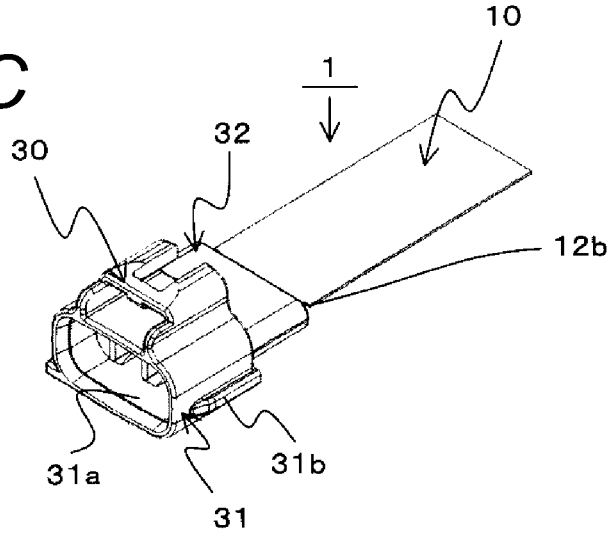

Now, a manufacturing method of the flat cable waterproof connector 1 will be described below by referring to FIGS. 8A to 8C. FIGS. 8A to 8C are diagrams showing the manufacturing method of the flat cable waterproof connector 1 shown in FIG. 1.

Initially, the insulating film 12*a* of the end part 10*a* in the extending direction is removed to expose end parts of the conductive wires 11*a* respectively. The exposed end parts of the conductive wires 11*a* are respectively connected to the terminals 20 by a method such as the ultrasonic welding method or the pressure welding method (see FIG. 8A).

Then, in the flat cable 10, the pair of cut-out parts 12*b* are formed (see 8B). The pair of cut-out parts 12*b* are formed at the positions where at least parts thereof are covered with the side end parts 12*d* opposed to each other in the transverse direction of the insulating sheath part 12 and the connector housing 30. More specifically, the cut-out parts 12*b* of the pair of cut-out parts 12*b* are respectively formed at the positions substantially equal to the position of the attaching side end 30*a* of the flat cable 10 of the connector housing 30.

After that, the connector housing 30 is formed integrally in the end part 10*a* in the extending direction of the flat cable 10 so as to cover the connecting part 40 (see FIG. 8C). Thus, the connector housing 30 is allowed to come into close contact with the connecting part 40 and the flat cable 10 so as to cover the connecting part 40 and the flat cable 10.

In the flat cable waterproof connector 1 of the exemplary embodiment of the present disclosure, since the connector housing 30 includes the mold part 32 formed integrally with the end part 10*a* in the extending direction of the flat cable 10 so as to cover the connecting part 40 of the conductive wires 11*a* and the terminals 20, the waterproofing performance can be obtained without attaching the waterproof plug between the connector housing 30 and the flat cable 10. As a result, the waterproofing performance is obtained and an attaching operation is made to be easy.

Further, in the flat cable waterproof connector 1 of the exemplary embodiment of the present disclosure, since the connecting part 40 is covered with the resin forming the connector housing 30, strength of the connecting part 40 can be improved.

Further, in the flat cable waterproof connector 1 of the exemplary embodiment of the present disclosure, since the resin forming the connector housing 30 enters the pair of cut-out parts 12*b*, the connector housing 30 is strongly held on the flat cable 10.

Further, in the flat cable waterproof connector 1 of the exemplary embodiment of the present disclosure, since the mold part 32 includes the waterproof mold part 32*a* which covers the connecting part 40 and the holding mold part 32*b* located more inward in the extending direction of the flat cable 10 than the waterproof mold part 32*a* to cover the flat cable 10, the load applied to the waterproof mold part 32*a* is reduced by the holding mold part 32*b*. Thus, the waterproof mold part 32*a* can be prevented from being broken. As a result, the waterproofing performance of the waterproof mold part 32*a* can be improved.

Further, in the flat cable waterproof connector 1 of the exemplary embodiment of the present disclosure, since the connector housing 30 includes the fitting part 31 having the hood part 31*a* which accommodates at least a part of the mating connector 50 and fitted to the mating connector 50, the waterproofing performance of the connecting part of the terminals 20 and the mating terminals 51 can be ensured.

Further, in the flat cable waterproof connector 1 of the exemplary embodiment of the present disclosure, since the fitting part 31 has the fitting lock part 31*b* for holding the fitting state to the mating connector 50, the fitting state of the connector housing 30 to the mating connector 50 can be more strongly held.

Further, since the manufacturing method of the flat cable waterproof connector 1 of the exemplary embodiment of the present disclosure includes an integrally forming step in which the connector housing 30 is formed integrally with the connecting part 40 of the conductive wires 11*a* and the terminals 20 and the flat cable 10, the waterproofing performance can be obtained without attaching the waterproof plug between the connector housing 30 and the flat cable 10. As a result, the waterproofing performance is obtained and the attaching operation is made to be easy.

First Modified Example

Now, a first modified example of the flat cable waterproof connector of the exemplary embodiment of the present disclosure will be described below by referring to FIG. 9 and FIG. 10.

Figure 9:
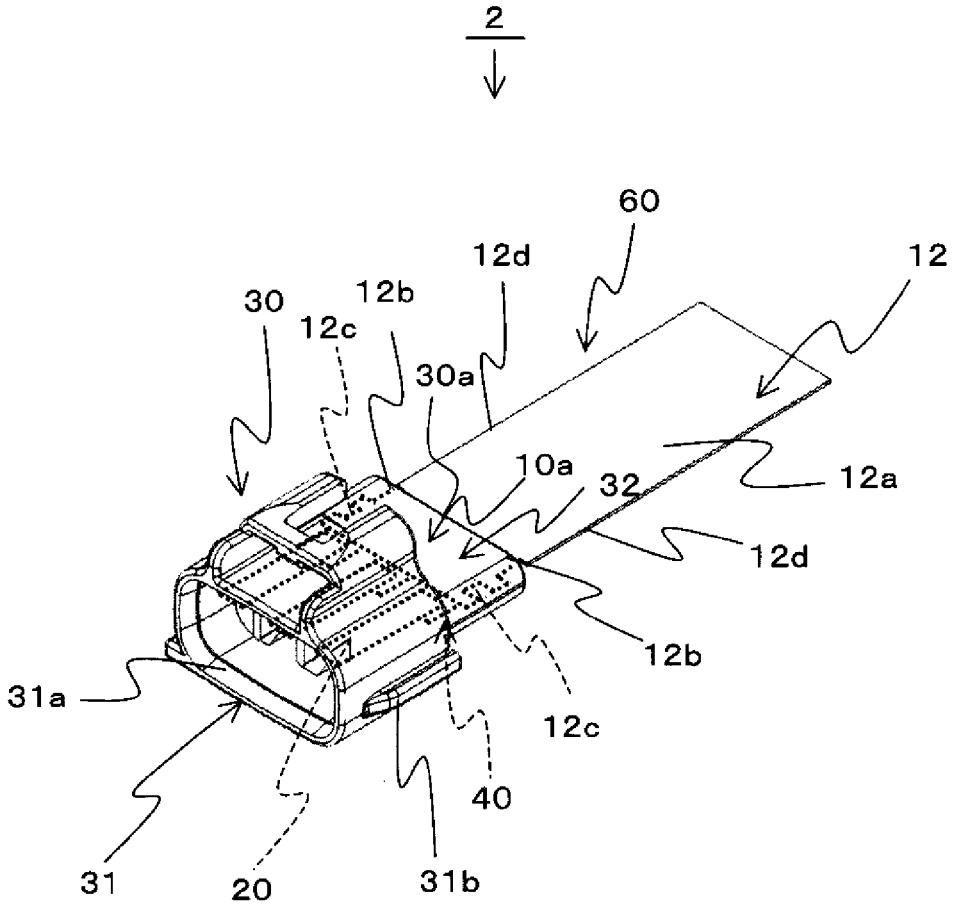
FIG. 9 is a perspective view of a flat cable waterproof connector of a first modified example of the exemplary embodiment of the present disclosure.
Figure 10:
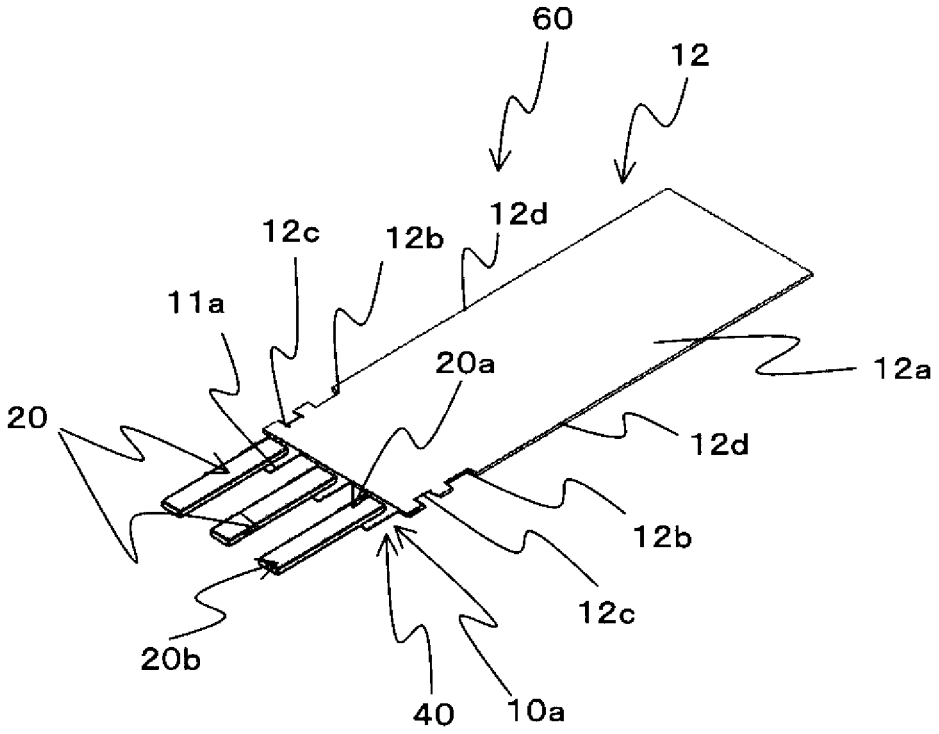
FIG. 10 is a diagram of a flat cable shown in FIG. 9 and terminals connected to the flat cable.

FIG. 9 is a perspective view of a flat cable waterproof connector 2 of a first modified example of the exemplary embodiment of the present disclosure. FIG. 10 is a diagram of a flat cable 60 shown in FIG. 9 and terminals 20 connected to the flat cable 60.

The flat cable waterproof connector 2 of the first modified example is different from the flat cable waterproof connector 1 in view of a point that pair of cut-out parts 12*c* are further formed in addition to pair of cut-out parts 12*b* in the flat cable 60.

Other structures are the same as those of the exemplary embodiment, and the same component parts as those of the exemplary embodiment are designated by the same reference numerals.

The pair of cut-out parts 12*c* are rectangular cut-out parts formed at positions where all parts are covered with side end parts 12*d* opposed to each other in a transverse direction of an insulating sheath part 12 and a connector housing 30.

In the flat cable waterproof connector 2 of the first modified example, since a resin forming the connector housing 30 enters the pair of cut-out parts 12*b* and the pair of cut-out parts 12*c*, the connector housing 30 is strongly held on the flat cable 60.

Second Modified Example

Now, a second modified example of the flat cable waterproof connector of the exemplary embodiment of the present disclosure will be described below by referring to FIG. 11 and FIG. 12.

Figure 11:
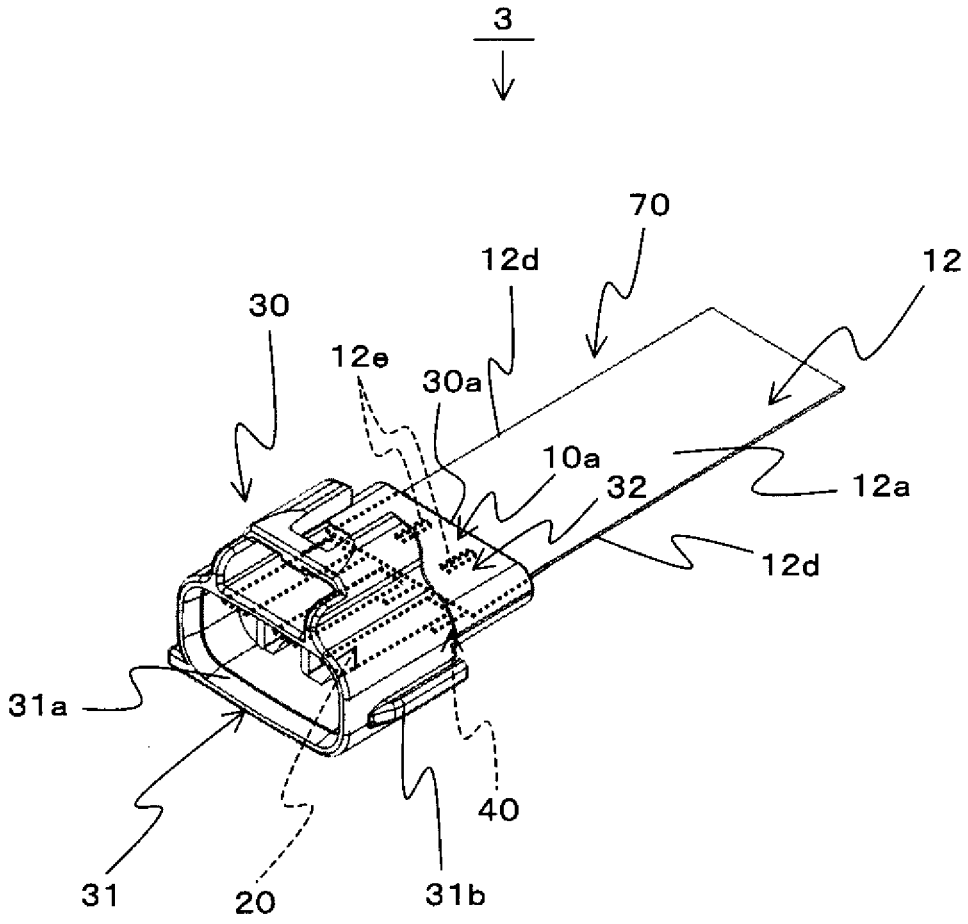
FIG. 11 is a perspective view of a flat cable waterproof connector of a second modified example of the exemplary embodiment of the present disclosure.
Figure 12:
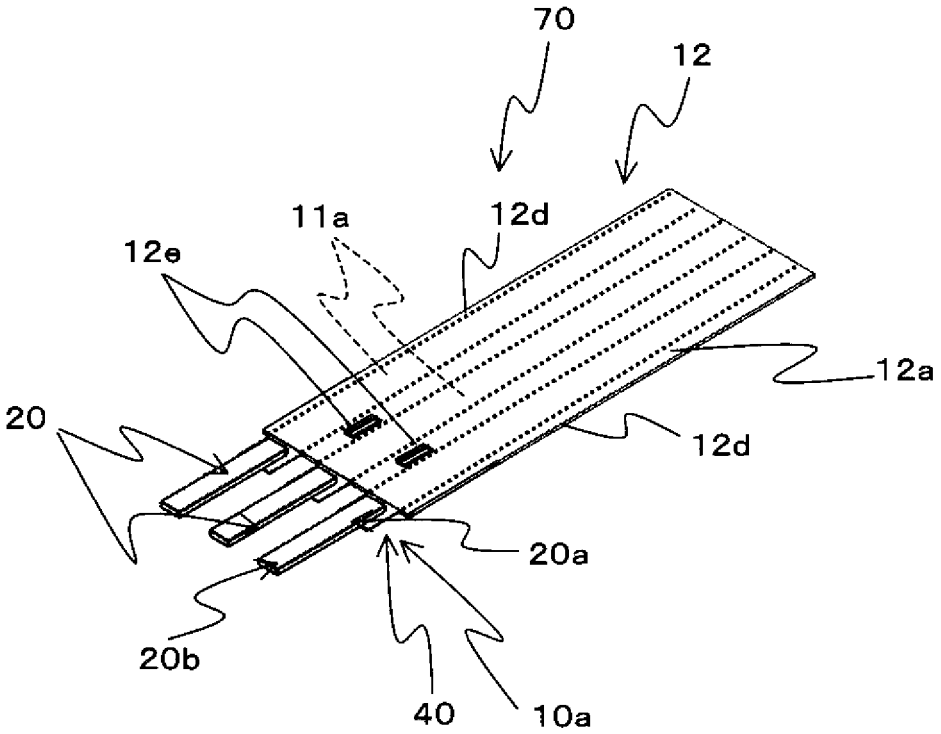
FIG. 12 is a diagram of a flat cable shown in FIG. 11 and terminals connected to the flat cable.

FIG. 11 is a perspective view of a flat cable waterproof connector 3 of a second modified example of the exemplary embodiment of the present disclosure. FIG. 12 is a diagram of a flat cable 70 shown in FIG. 11 and terminals 20 connected to the flat cable 70.

The flat cable waterproof connector 3 of the second modified example is different from the flat cable waterproof connector 1 in view of a point that through holes 12*e* are formed in an insulating sheath part 12 of the flat cable 70 in place of the pair of cut-out parts 12*b*.

Other structures are the same as those of the exemplary embodiment, and the same component parts as those of the exemplary embodiment are designated by the same reference numerals.

The through holes 12*e* are formed at positions covered with a connector housing 30. In the second modified example, the through holes 12*e* are formed between conductive wires 11*a* as shown in FIG. 12.

The positions where the through holes 12*e* are formed are not limited to positions between the conductive wires 11*a*. Namely, the through holes 12*e* may be formed at other positions covered with the connector housing 30.

In the flat cable waterproof connector 3 of the second modified example, since a resin forming the connector housing 30 enters the through holes 12*e*, the connector housing 30 is strongly held on the flat cable 70.

The flat cable waterproof connectors 1 and 2 according to the exemplary embodiment of the present disclosure are exemplified which respectively have the rectangular cut-out parts 12*b* and 12*c*. However, the present disclosure is not limited thereto and cut-out parts having other shapes may be formed. For instance, U-shaped cut-out parts may be formed.

The flat cable waterproof connectors 1 and 2 according to the exemplary embodiment of the present disclosure are exemplified in which the cut-out parts 12*b* of the pair of cut-out parts 12*b* are respectively formed at the positions substantially equal to the position of the attaching side end 30*a* of the connector housing 30. However, the present disclosure is not limited thereto. Namely, the pair of cut-out parts 12*b* may be formed at the positions where at least parts thereof are covered with the side end parts 12*d* opposed to each other in the transverse direction of the insulating sheath part 12 and the connector housing 30. For instance, all the cut-out parts 12*b* of the pair of cut-out parts 12*b* may be respectively covered with the connector housing 30.

Further, the flat cable waterproof connectors 1, 2 and 3 of the exemplary embodiment of the present disclosure are exemplified in which the terminals 20 are the male terminals. However, the present disclosure is not limited thereto and the terminals 20 may be female terminals.

Further, in the flat cable waterproof connectors 1, 2 and 3 of the exemplary embodiment of the present disclosure, the connector housing 30 is exemplified which has the fitting part 31 of an elliptic tubular outer form in section and to which the mating connector 50 is fitted. However, the present disclosure is not limited thereto. Namely, other forms may be used to which the mating connector 50 is fitted.

As described above, the invention devised by the inventor is specifically explained in accordance with the above-described exemplary embodiment of the present disclosure. However, the present disclosure is not limited to the above-described exemplary embodiment of the present disclosure and may be variously changed within a range that does not deviate from the gist thereof.

By the above configuration of the present disclosure, a waterproof connector in which a waterproofing performance can be obtained and an attaching operation is easy can be obtained.

What is claimed is:

1. A waterproof connector comprising:

a flat cable comprising an insulating sheath part in which a conductive wire is coated with an insulating film;

a terminal connected to the conductive wire; and a connector housing comprising a fitting part being fitted to a mating connector so as to connect the terminal to a mating terminal of the mating connector, wherein the connector housing comprises a mold part which is integrally formed with an end part in an extending direction of the flat cable and which covers a connecting part of the conductive wire and the terminal;

wherein the insulating sheath part comprises a pair of cut-out parts;

wherein the pair of cut-out parts are formed at positions which are covered with the connector housing and located at side end parts of the insulating sheath part opposed to each other in a transverse direction of the insulating sheath part, wherein the mold part is continuously formed with the fitting part of the connector housing, and wherein the mold part is integrally formed with the end part of the flat cable without an addition of a sealant or potting compound.

2. The waterproof connector according to claim 1, wherein the mold part comprises:

a waterproof mold part which covers the connecting part; and a holding mold part arranged between the waterproof mold part and the flat cable to cover the flat cable.

3. The waterproof connector according to claim 1, wherein the connector housing comprises a fitting part which is fitted to the mating connector; and wherein the fitting part comprises a hood part which accommodates at least a part of the mating connector.

4. The waterproof connector according to claim 3, wherein the fitting part comprises a fitting lock part which holds a fitting state to the mating connector.

5. A waterproof connector comprising:

a flat cable comprising a conductive wire coated with an insulating film forming an insulating sheath;

a terminal connected to the conductive wire; and a connector housing comprising a fitting part configured to be fitted to a mating connector so as to connect the terminal to a mating terminal of the mating connector, wherein the connector housing further comprises a mold part integrally formed with an end part of the flat cable and covering a connecting part of the conductive wire and the terminal to waterproof the connecting part, wherein the mold part is continuously formed with the fitting part of the connector housing, and wherein the mold part is integrally formed with the end part of the flat cable without an addition of a sealant or potting compound.

* * * * *